United States Patent [19]

Roberts

[11] 4,456,022

[45] Jun. 26, 1984

[54] FLATWARE WASHING MACHINE

[76] Inventor: Donald E. Roberts, 4250 Saratoga Ave., Downers Grove, Ill. 60515

[21] Appl. No.: 432,652

[22] Filed: Jan. 5, 1983

Related U.S. Application Data

[63] Continuation-in-part of Ser. No. 311,998, Oct. 16, 1981.

[51] Int. Cl.[3] ..... B08B 3/02

[52] U.S. Cl. ..... 134/99; 134/142; 134/153

[58] Field of Search ..... 134/99, 102, 140, 142, 134/148, 153, 157, 198, 200

[56] References Cited

U.S. PATENT DOCUMENTS

| | | | |
|---|---|---|---|
| 1,313,703 | 8/1919 | Lambert | 134/142 |
| 2,712,826 | 7/1955 | Schleyer et al. | 134/148 X |
| 4,233,083 | 11/1980 | Roberts | 134/25.2 |

FOREIGN PATENT DOCUMENTS

| | | | |
|---|---|---|---|
| 2731674 | 1/1979 | Fed. Rep. of Germany | 134/140 |
| 821438 | 8/1937 | France | 134/153 |
| 695,435 | 9/1965 | Italy | 134/153 |

*Primary Examiner*—Robert L. Bleutge
*Attorney, Agent, or Firm*—John S. Fosse

[57] ABSTRACT

Flatware apparatus comprises a support platform, mechanical arrangements for mounting the platform, and respective washing and rinsing sprays. The platform is adapted to receive a cylindrical cup or holder for grouping a plurality of flatware pieces in a shock; and a drive arrangement is provided for causing rotation of the platform, or the cup or holder, so that the flatware pieces experience agitated movement. The wash spray is positioned to direct jets of washing and sanitizing fluid into the path of the churning flatware pieces. Mechanical arrangements are also provided for selectively lifting the flatware pieces in the cup in order to fully expose the food-contact surfaces thereof to the washing action.

18 Claims, 6 Drawing Figures

FIG. 2
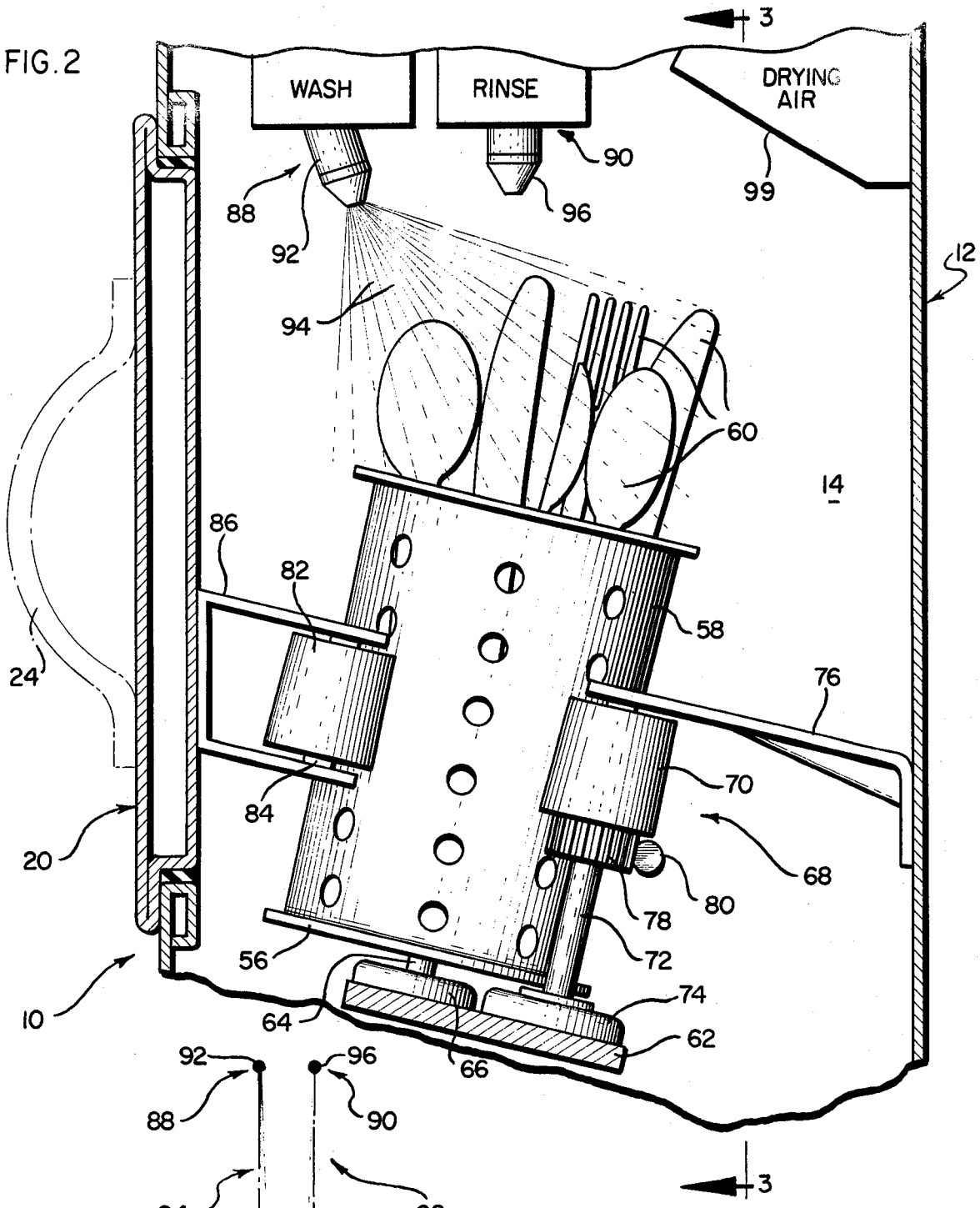
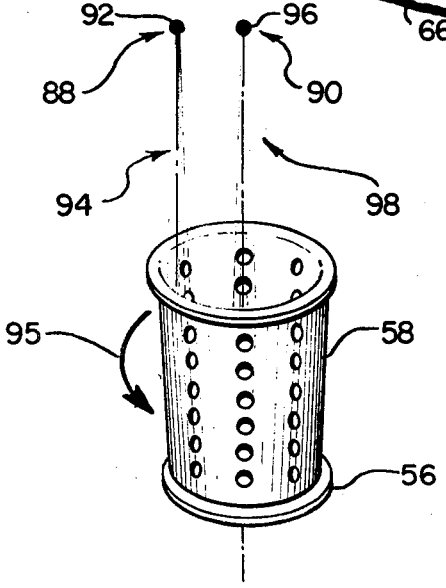
FIG. 3

6
6
116
118
58a
60a
102
104
106
108
100
110
112
114
120
122
124
126
10a
56a

FLATWARE WASHING MACHINE

This application is a continuation-in-part of my application Ser. No. 311,998 filed Oct. 16, 1981.

FIELD OF THE INVENTION

This invention relates generally to equipment for use in the restaurant and food service industry and more particularly to apparatus for washing items of reusable flatware utensils such as forks, knives and spoons.

BACKGROUND OF THE INVENTION

It is common practice in the food service industry to shock knives, forks and spoons in the handles-down mode in tall, perforated plastic cups after soaking and removal of the gross food accumulations. Thereafter, the cups of flatware are processed through a conventional dishwashing machine in an effort to complete the cleaning. However, individual pieces of flatware tend to mask adjacent pieces in the shock, preventing the high-pressure washing and rinsing sprays from reaching many surfaces that have been contaminated with smears of food or with substances from the user's mouth. Spoons are particularly susceptible to undersirable nesting, and the inside edges of fork tines constitute a comparatively inaccessible residence of potential contamination. Moreover, the high-pressure wash sprays of conventional tablewarewashing equipment, being directed generally axially of the pieces of shocked flatware, tend to "lock" undesirably nested pieces in that configuration, thus thoroughly frustrating complete cleansing. In addition, research has brought out that freshly washed hospital flatware oftentimes harbors a sufficiently vigorous and varied flora of micro-organisms to cause nosocomial infections. Restaurant flatware poses a somewhat similar source of contagion.

SUMMARY OF THE INVENTION

The present invention overcomes the limitations of the prior art by arranging a flatware washing machine to impart a churning motion of the flatware items shocked in the perforated cups or holders in order to maximize the exposure of the flatware surfaces to washing and rinsing sprays and to drying air. In one form of the invention, cascading motion is imparted to the flatware utensils. As a supplement or as an alternative, means are provided for selectively lifting the flatware pieces in the cup in order to fully expose the food-contact surfaces thereof to the washing action.

Accordingly, a general object of the present invention is to provide new and improved apparatus for washing flatware.

Another object of the invention is to provide apparatus for both washing and drying flatware effectively.

Still another object of the invention is to provide a flatware washing machine that automatically ensures that cascading motion is imparted to flatware items shocked in cup holders that are loaded into the machine.

Yet another object of the invention is to provide flatware washing apparatus which promotes exposure of the food-contact surfaces of the flatware pieces to the washing action.

These and other objects and features of the invention will become more apparent from a consideration of the following descriptions.

BRIEF DESCRIPTION OF THE DRAWINGS

In order that the principles of the invention may be readily understood, two embodiments thereof, applied to a free-standing, cabineted construction but to which the application is not to be restricted, are shown in the accompanying drawings wherein:

FIG. 2 is an enlarged, side elevational view taken in cross-section through the washing chamber of the apparatus of FIG. 1 to show both the angle of inclination of the cup-supporting platform and the flatware holder drive arrangements;

FIG. 3 is a perspective view on a reduced scale, taken along the line 3—3 of FIG. 2 and showing the position of the wash and rinse sprays relative to the direction of rotation of the holder and its supporting platform;

DETAILED DESCRIPTION OF THE INVENTION

Figure 1:
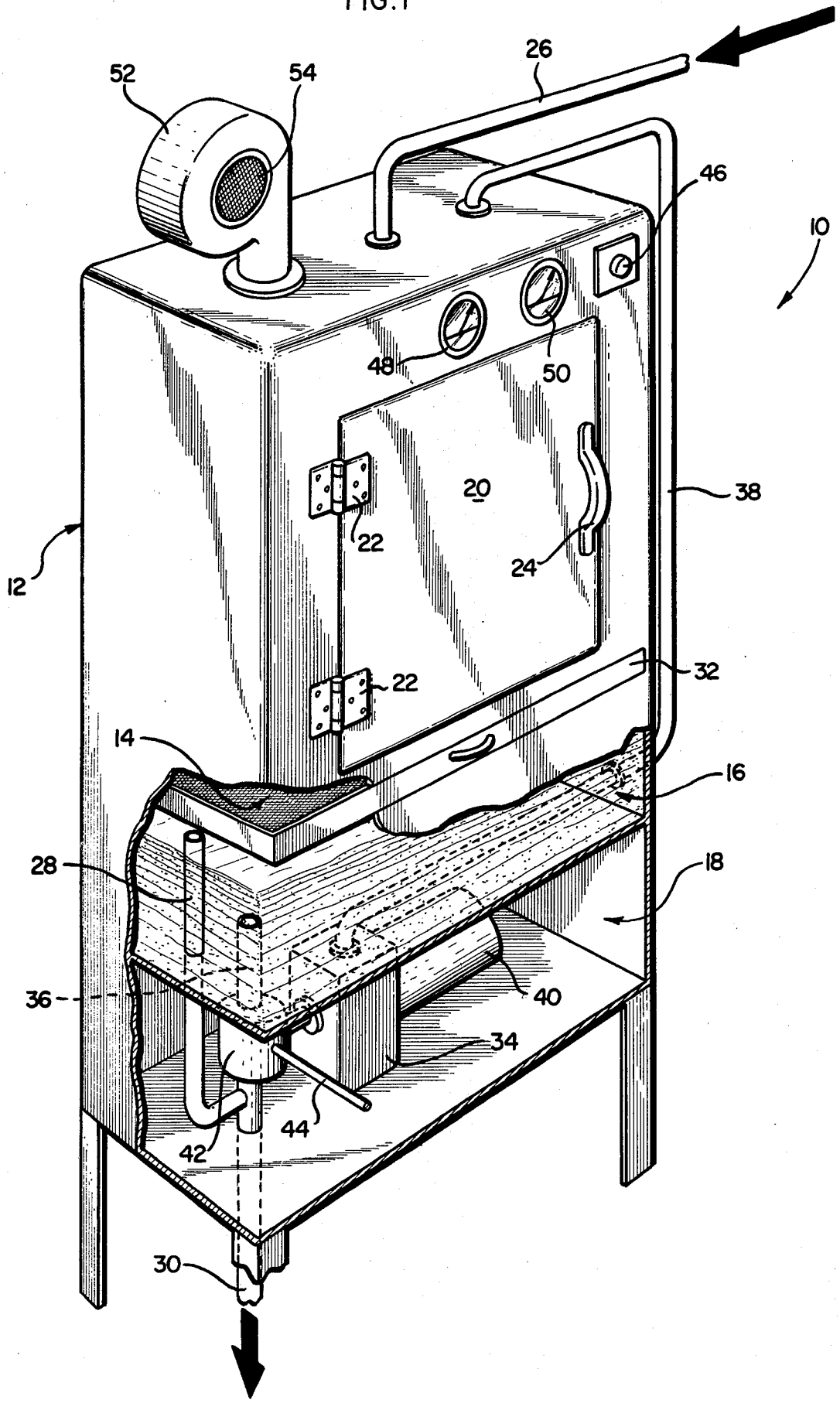
FIG. 1 is a perspective view of flatware washing apparatus constructed in compliance with the present invention.

Referring now in detail to the drawings, specifically to FIG. 1, flatware washing apparatus indicated generally by the reference numeral 10 comprises a cabinet or housing 12 which encloses a flatware washing chamber 14, a washwater storage chamber 16 and a mechanical equipment chamber 18, the chambers 14, 16 and 18 being vertically stacked in order to minimize the floor-space requirements of the apparatus. Access to the washing chamber 14 is made through a loading door 20 which is swingably mounted on hinges 22 and which is provided with a handle 24 for facility in usage. Inlet water for use in rinsing and in mixing with sanitizing materials in the tank of chamber 16 enters through a conduit or line 26; and a stationary standpipe 28 is arranged to maintain a preselected liquid level in chamber 16, the standpipe 28 draining directly to a sewer line 30. Standpipe 28 also serves to skim scum from the surface of the washing liquid in chamber 16; and advantageously, a slideably removable screen drawer 32 is interposed between chambers 14 and 16 to serve as a baffle and in order to collect gross effluvia accidentially included with the flatware being sanitized in chamber 14.

A recirculation pump 34 draws wash liquid from the chamber 16 through an inlet line 36 and delivers it at a boosted pressure to the wash spray or sprays through a recirculation line 38. The pump 34 is driven by an electrically-operated motor 40 and receives inlet washing fluid from the line 36 through a valve 42 which is manually regulated by a handle, not shown, attached to a shaft 44.

A starter button 46 is provided for selectively electrically energizing the motor 40 and the other electrically energized devices in the apparatus 10; and temperature gages 48 and 50 are included for sensing and displaying the respective thermal levels in the inlet water line 26 and the recirculation washing liquid line 38. In addition, a blower 52 is situated atop the cabinet 12 for free exposure of its air inlet 54, blower 52 including an electrically energized fan motor and suitable arranged blades for delivering drying air to the items of flatware being sanitized in chamber 14. Conventional control circuitry is provided for intermittently operating the blower 52 after completion of the wash and rinse cycles.

Turning to FIG. 2, the apparatus 10 includes a rotatable platform 56 which is housed in washing chamber 14 and which is adapted to receive and support a cylindrical, perforated cup 58 that is used for holding a plurality of flatware pieces 60 in handles-down, loosely shocked, substantially upright condition as shown. In order to dispose the platform 56 at an angle inclined from the horizontal, a bracket 62 is fastened in the chamber 14 attached to appropriate portions of the cabinet 12. In the illustrated embodiment, the platform 56 is arranged to take disc shape and is secured to a central shaft 64, shaft 64 being, in turn, journaled for free rotation in a bearing unit 66. With the cup or holder 58 thus angularly inclined, its rotation causes the flatware pieces 60 to cascade within its confines under the influence of gravity.

The apparatus 10 accordingly includes drive means for causing rotation of the perforated cup 58; and in the disclosed embodiment, a drive arrangement 68 advantageously includes a pair of resilient drive rollers 70 which are mounted on respective shafts 72, spaced apart by a suitable horizontal distance for engaging the cup 58 at points spaced on one side of the diamater thereof. The shafts 72 are mounted for free rotation in bearings 74 which are secured to the bracket 72, the shafts 72 being journaled at their upper ends to a bracket 76, which is fastened to a cabinet wall of the housing 12. A pinion gear 78 is mounted on each of the shafts 72; and these pinions are engaged by a common worm 80, the worm 80 being rotated from a suitable, electrically energized motor, not shown.

In order to ensure driving engagement between the cup or holder 58 and the drive rollers 70, a pair of resilient, spaced idler rollers 82 are rotatably mounted on the inside surface of door 20 by means of respective shafts 84 and a C-shaped bracket 86. Hence, after a cup filled with flatware has been placed on the platfrom 56 and the door 20 is closed and latched in the closed position, the idler rollers 82 engage and resiliently urge the cup 58 into frictional, driving engagement with the rollers 70.

The chamber 14 also houses an overhead wash-spray unit 88 and an overhead rinse-spray unit 90, connected respectively to the recirculation line 38 and the inlet water line 26 through suitably cycled valving, not shown. Continuing with reference to FIG. 2, with supplemental reference to FIG. 3, and in compliance with an important feature of the present invention, the wash-spray unit 88 includes a nozzle 92 which is positioned to direct "knife" pattern fan jets 94 of the washing and sanitizing fluid into the path of the cascading flatware pieces generally downhill from the apogee of their transit, as is shown in FIG. 3. So arranged, the wash nozzle 92 cooperates with the rotation imparted to the cup holder 58 in the direction of arrow 95 in FIG. 3, in achieving a contact of the wash and sanitizing fluid with substantially all of the surfaces of the flatware pieces 60, the adverse effects of shading and nesting being substantially circumvented by the relative movement of the flatware pieces in the jets of washing and sanitizing fluid. Pressurizing the fluid delivered by the nozzle 92 enhances both separation of the flatware pieces and the resultant efficacy of the washing action.

The rinse-spray unit 90 includes a nozzle 96 which is positioned to direct jets 98 of heated rinse water from the inlet line 26 generally into the path of the orbiting flatware pieces spaced apart from the path of the jets of washing fluid. Conveniently, the rinse jets 98 are situated nearer the diameter of the cup 58 than the jets 94 for the washing and sanitizing fluid according to the showing of FIG. 3. As will be appreciated, conventional means are provided for appropriately cycling the action of the wash-spray unit 88 and the rinse-spray unit 90.

Heated drying air from the blower 52 is also cycled in a stream from a blower outlet 99 generally axially of the flatware pieces contained in the holder cup 58 during that portion of the cycle in which the spray units 88 and 90 are not operative. This axial air flow tends to blow excess water droplets onto the flatware handles where water-spotting is of lesser concern. Because the holder cup 58 and the flatware pieces 60 are rotated, the blower and the water jets may be stationary rather than revolving.

Figures 4, 5, 6:
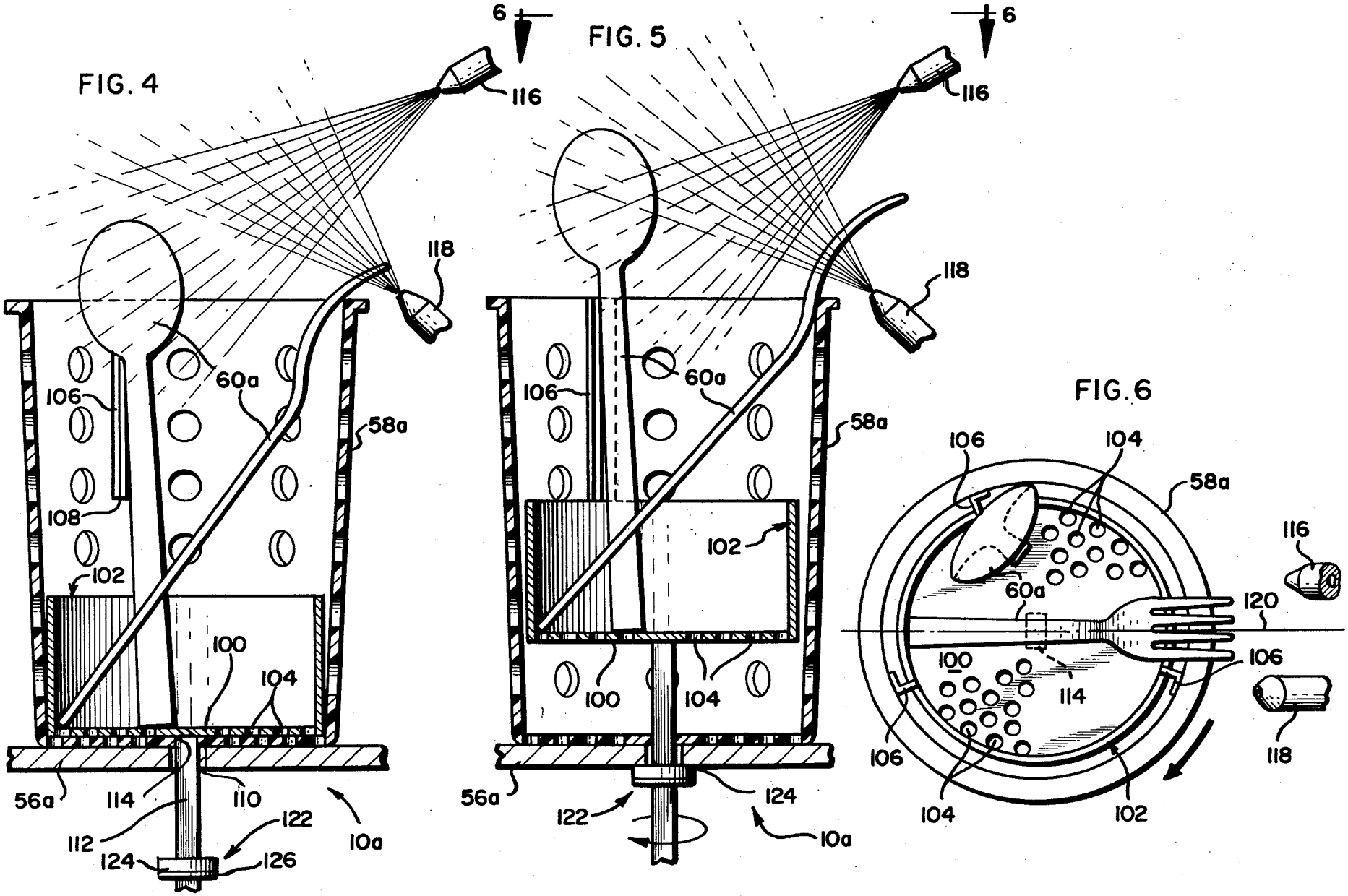
FIG. 4 is a central sectional view showing a modified cup holder which incorporates a lifter insert in accordance with the invention, the lifter insert being shown in its retracted position.
FIG. 5 is a view similar to the showing of FIG. 4 but illustrating the lifter insert in its elevated position for exposing the food-contact surfaces of the flatware utensils to the jets of washing fluids.
FIG. 6 is top plan view taken substantially along the line 6—6 of FIG. 5.

In order to enhance the understanding of the invention, a modified embodiment thereof is shown in FIGS. 4–6. Elements in the embodiment of FIGS. 4–6 which are similar to those employed in the embodiment of FIGS. 1–3 have been identified by like reference numerals with the suffix letter "a" being employed to distinguish these elements associated with the embodiment of FIGS. 4–6.

The flatware washing apparatus **10*a* is characterized by the provision of a lifter platform 100 which is situated in the cup holder 58*a* for movement between a first retracted position for the flatware pieces 60*a*, illustrated in FIG. 4, and a second elevated position for raising the food-contact surfaces of the flatware pieces above the lip of the cup 58*a* and fully into exposure to the washing fluid jets, as shown in FIG. 5. The lifter platform 100 usefully comprises the bottom of a cylindrical, cup-shaped insert member 102; and the bottom lifter platform 100 is also advantageously perforated with a suitable pattern of drain holes 104. In addition, the insert member 102 is dimensioned to be freely slidable axially within the cup holder 58*a***.

In order to define a mechanical upstop for the insert number 102, a suitable number of radially inwardly projecting, equally arcuately spaced vanes 106 is fastened to the inside wall of the cup holder **58*a* extending generally longitudinally thereof, bottom end portions 108 of the vanes 106 specifically defining the mechanical stops for the insert member 102 at a distance from the bottom of the cup that typically raises the flatware pieces about one-inch about the rim of the cup. Other forms of stops may be employed to replace the vanes 106**; but utilization of radially inwardly projecting, longitudinally extending vanes is advantageous in that they serve to transmit generally rotative force to the various flatware pieces for promoting agitated motion thereof. Regardless of their form, these upstops preserve the assembled condition of the cup holder and the insert members to prevent undesirable loss of the insert member in the general course of handling.

In accordance with another feature of the modified apparatus **10*a*, the platform 56*a* is stationarily mounted and is apertured with a hole 110 which freely passes a vertically reciprocable, rotatably driven shaft 112 into engagement with the cup holder 58***a*. Cooperatively, the rotatable shaft 112 is fashioned with rectangular cross-section and the bottom of the cup holder 58*a* is perforated with a matching keyway 114 for fittedly receiving the end of shaft 112 and imparting rotational force from the shaft to the cup holder 58*a*. In such instance, the various rollers which engage the exterior surface of the cup holder are uniformly arranged to be idlers. When it is desired to lift the insert member 102, suitable mechanical means such as a rack-and-pinion arrangement, not shown, are actuated to advance the shaft 112 to elevate the insert member for fanning or splaying the flatware utensils. Reverse action lowers the shaft.

The apparatus 10*a* is particularly arranged to embody a first, upper spray device 116 which is focused generally downwardly toward the lip of the cup holder 58*a*, as is shown in FIGS. 4 and 5, from a rotationally upstream relative position, as is shown in FIG. 6. A second spray device 118 is focused generally upwardly toward the lip of the cup holder 58*a* as is shown in FIGS. 4 and 5, where it directs the jets of washing fluid into maximum contact with the flatware food-contact surfaces in their elevated position, as is shown in FIG. 5. Moreover, the second spray device 118 is disposed rotationally subsequent to the spray device 116 in order to create a relatively quiet zone of reduced relative motion for the flatware pieces between the two spray devices, it having been found that transition of the flatware pieces from such a relatively quiet zone and into a zone of agitated motion caused by impinging jets of washing fluid enhances the exposure of the flatware food-contact surfaces to the washing action. As will be appreciated, a secondary quiet zone exists in the major arc of travel in the direction of cup rotation between spray device 118 and spray device 116. Continuing with reference to FIG. 6, it has proved advantageous to space the spray devices 116 and 118 at equal distances from and on the opposite sides of an axial plane 120 which bisects the cup holder 58*a*, thus tending to balance the effect of jet spray forces on the cup holder 58*a*.

An upstop 122 is usefully mounted on the shaft 112 to comprise an elastomeric bumper 124 and a back-up plate 126, bumper 124 resiliently engaging the platform 56*a* in the elevated position of the lifter insert member 102. Furthermore, the described positioning of the several spray devices 116 and 118 in the flatware washing apparatus 10*a* allows horizontal disposition of the platform 56*a* and convenient upright situation of the cup holder 58*a*.

As will be appreciated, the use of the flatware lifter system described immediately hereinabove serves to fan the flatware pieces which have been loaded into the cup or holder 58*a*. This fanning action is especially important to proper cleaning of the utensils when the soiled pieces have been tightly packed into the holder in the first instance by the kitchen attendants.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for purposes of limitation, the scope of the invention being delineated in the following claims:

The following is claimed as invention:

1. Flatware washing apparatus comprising: rotatable platform means adapted to receive and support a cylindrical cup for holding a plurality of flatware pieces in loosely shocked, substantially upright condition; mounting means for disposing said platform means at an angle inclined from the horizontal whereby the flatware pieces tend to cascade under gravitational influence upon rotation of said cup; drive means for causing rotation of said cup about its own individual axis; first spray means including first nozzle means positioned to direct jets of washing and sanitizing fluid into the path of the cascading flatware pieces generally downhill from the apogee of their orbiting transit; and second spray means including second nozzle means positioned to direct jets of rinse fluid into the path of the orbiting flatware pieces apart from the path of the jets of washing fluid.

2. A flatware washing apparatus according to claim 1 which further includes cabinet means for housing said rotatable platform means and said first and second spray means.

3. A flatware washing apparatus according to claim 2 wherein said cabinet means includes reservoir means for supplying said washing and sanitizing fluid to said first nozzle means and pump means for recycling said fluid.

4. A flatware washing apparatus according to claim 2 wherein said cabinet means includes a loading door and wherein said drive means includes drive roller means mounted within said cabinet means for drivable engagement with said cup and idler roller means mounted on the inside wall of said door for automatically urging said cup into frictional engagement with said drive roller means when said door is closed.

5. A flatware washing apparatus according to claim 1 which further comprises means for directing a flow of drying air against the shock of cascading flatware pieces.

6. Flatware washing apparatus comprising: processing means for supporting a cylindrical, flatware-holding cup at an angle inclined from the horizontal and for rotating said cup about its own individual axis to cause the flatware pieces to cascade freely under the influence of gravity; and spray means for directing jets of washing fluid into the path of the cascading flatware pieces generally downhill from the apogee of their orbiting transit.

7. Flatware washing apparatus comprising: a cylindrical, flatware-holding cup; processing means for supporting said cup at an angle inclined from the horizontal; means for rotating said cup about its own individual axis to cause flatware pieces contained therein to cascade freely under the influence of gravity; spray means for directing jets of washing fluid into the path of the cascading flatware pieces; lifter platform means disposed within said cup for movement between a first, retracted position for the flatware pieces and a second, elevated position raising the food-contact surfaces of the flatware pieces above the lip of said cup and fully into exposure to said jets; and selectively operable, platform actuating means for relocating said lifter platform means from one to the other of said first and second positions.

8. Flatware washing apparatus according to claim 7 which further comprises a plurality of radially inwardly projecting vanes on the inside wall of said cup, extending longitudinally thereof for transmitting generally rotative mixing forces to the flatware pieces.

9. Flatware washing apparatus according to claim 8 wherein said vanes include bottom end portions spaced above the bottom of said cup to define mechanical stop means for said platform means at said second position.

10. Flatware washing apparatus according to claim 7 wherein said spray means includes a first spray device focused toward said cup in a first direction and a second spray device focused toward said cup in a second direction rotationally spaced subsequent to said first direction whereby to create relatively quiet zones of reduced relative motion for the flatware pieces therebetween, transition of the flatware pieces from a relatively quiet zone to a zone of agitated motion caused by impinging jets of washing fluid enhancing the exposure of the flatware food-contact surfaces to the washing action.

11. Flatware washing apparatus according to claim 10 wherein said first spray device is focused generally downwardly toward the lip of said cup and wherein said second spray device is focused generally upwardly toward the lip of said cup.

12. Flatware washing apparatus comprising: a cylindrical, flatware-holding cup; means for rotating said cup; spray means for directing jets of washing fluid into the path of the flatware pieces; lifter platform means disposed within said cup for movement between a first, retracted position for the flatware pieces and a second, elevated position raising the food-contact surfaces of the flatware pieces above the lip of said cup and fully into exposure to said jets; and selectively operable, platform actuating means for relocating said lifter platform means from one to the other of said first and second positions.

13. Flatware washing apparatus according to claim 12 which further comprises a plurality of radially inwardly projecting vanes on the inside wall of said cup extending longitudinally thereof for transmitting generally rotative mixing forces to the flatware pieces.

14. Flatware washing apparatus according to claim 13 wherein said vanes include bottom end portions spaced above the bottom of said cup to define mechanical stop means for said platform means at said second position.

15. Flatware washing apparatus according to claim 12 wherein said spray means includes a first spray device focused toward said cup in a first direction and a second spray device focused toward said cup in a second direction rotationally spaced subsequent to said first direction whereby to create relatively quiet zones of reduced relative motion for the flatware pieces therebetween, transition of the flatware pieces from a relatively quiet zone to a zone of agitated motion caused by impinging jets of washing fluid enhancing the exposure of the flatware food-contact surfaces to the washing action.

16. Flatware washing apparatus according to claim 15 wherein said first spray device is focused generally downwardly toward the lip of said cup and wherein said second spray device is focused generally upwardly toward the lip of said cup.

17. Flatware washing apparatus comprising: a cylindrical flatware-holding cup; processing means for supporting said cup at an angle inclined from the horizontal; means for rotating said cup about its own individual axis to cause flatware pieces contained therein to cascade under the influence of gravity; and spray means for directing jets of washing fluid into the path of the circulating flatware pieces, said spray means including a first spray device focused toward said cup in a first direction and a second spray device focused toward said cup in a second direction rotationally spaced subsequent to said first direction whereby to coact with the cascading motions of the flatware pieces to enhance the relative motion of the flatware pieces with respect to each other.

18. Flatware washing apparatus according to claim 17 wherein said first spray device is focused generally downwardly toward the lip of said cup and wherein said second spray device is focused generally upwardly toward the lip of said cup.

* * * * *